US008863422B2

(12) United States Patent
Ballard

(10) Patent No.: US 8,863,422 B2
(45) Date of Patent: Oct. 21, 2014

(54) MAGAZINE WITH DETACHABLE FEED LIP ELEMENT

(75) Inventor: Michael W. Ballard, Cerritos, CA (US)

(73) Assignee: Brookshire Tool & Mfg. Co., Inc., South Gate, CA (US)

( * ) Notice: Subject to any disclaimer, the term of this patent is extended or adjusted under 35 U.S.C. 154(b) by 106 days.

(21) Appl. No.: 13/556,168

(22) Filed: Jul. 23, 2012

(65) Prior Publication Data

US 2014/0075808 A1 Mar. 20, 2014

(51) Int. Cl.
*F41A 9/70* (2006.01)
*F41A 9/65* (2006.01)
*F41A 9/71* (2006.01)

(52) U.S. Cl.
CPC ... *F41A 9/65* (2013.01); *F41A 9/70* (2013.01); *F41A 9/71* (2013.01)
USPC ..... 42/49.01

(58) Field of Classification Search
CPC ..... F41A 9/65; F41A 9/69; F41A 9/70
USPC ..... 42/49.01, 49.02, 50
See application file for complete search history.

(56) References Cited

U.S. PATENT DOCUMENTS 1,044,983 A * 11/1912 Brown ..... 42/50
1,375,322 A * 4/1921 Rosebush ..... 42/50
3,453,762 A * 7/1969 Fremont ..... 42/50
3,516,189 A * 6/1970 Badali et al. ..... 42/50
3,676,946 A * 7/1972 Sibilia ..... 42/50
4,472,900 A * 9/1984 Howard ..... 42/50
4,901,463 A * 2/1990 Chesnut ..... 42/50
5,113,604 A * 5/1992 Vyprachticky ..... 42/50
5,168,648 A * 12/1992 Brandl et al. ..... 42/50
5,561,258 A * 10/1996 Bentley et al. ..... 89/33.17
6,739,082 B2 * 5/2004 Christensen ..... 42/6
2011/0107901 A1 * 5/2011 Lasichak et al. ..... 89/33.02

* cited by examiner

*Primary Examiner* — Bret Hayes

(74) *Attorney, Agent, or Firm* — Bennet K. Langlotz; Langlotz Patent & Trademark Works, Inc.

(57) ABSTRACT

Magazines with detachable feed lip elements have a tubular body having a lower end and an upper end that defines an elongated passage that receives a spring and a detachable feed element positioned on top of the upper end of the passage that has feed lips that retain cartridges in the magazine and permit the cartridges to be extracted forwardly. The feed element may be a U-shaped device having a main upper panel that defines a feed lip aperture. The feed element may have side walls with fasteners that connect the feed element to the body. The feed element may have opposed sides, the aperture may be defined by the opposed sides, and a spring may be attached to one of the opposed sides to provide a biasing force toward the other opposed side such that a cartridge cannot be extracted from the aperture except in a forward direction.

16 Claims, 6 Drawing Sheets

MAGAZINE WITH DETACHABLE FEED LIP ELEMENT

FIELD OF THE INVENTION

The present invention relates to firearms, and more particularly to a magazine with detachable feed lip element for rimmed cartridges.

BACKGROUND OF THE INVENTION

A magazine is an ammunition storage and feeding device within, or attached to, a repeating firearm. The magazine functions by moving the cartridges stored in the magazine into a position where they may be chambered by the action of the firearm. Most magazines designed for use with a reciprocating bolt firearm utilize a set of feed lips which stops the vertical motion of the cartridges out of the magazine but allows one cartridge at a time to be pushed forward (stripped) out of the feed lips by the firearm's bolt into the chamber.

Some form of spring and follower combination is almost always used to feed cartridges to the lips, which can be located either in the magazine (most removable box magazines) or built into the firearm (fixed box magazines). In a single feed design, the top cartridge touches both lips and is commonly used in single column box magazines.

A box (or "stick") magazine, the most popular type of magazine in modern rifles and handguns, stores cartridges in a straight or gently curved column, either one above the other or staggered zigzag fashion. As the firearm cycles, cartridges are moved to the top of the magazine by a follower driven by spring compression to either a single feed position or alternating feed positions. In most firearms, the magazine follower engages a slide-stop to hold the slide back and keep the firearm out of battery when the magazine is empty and all rounds have been fired. Box magazines may be integral to the firearm or removable.

A detachable box magazine is a self-contained mechanism capable of being loaded or unloaded while detached from the host firearm. They are inserted into a magazine well in the firearm receiver usually below the action, but occasionally positioned to the side or on top. When the magazine is empty, it can be detached from the firearm and replaced by another full magazine. This significantly speeds the process of reloading, allowing the operator quick access to ammunition. This type of magazine may be straight or curved, the curve being necessary if the firearm uses rimmed ammunition or ammunition with a tapered case.

Single stack magazines are inherently more reliable because they require less pressure to feed and apply limited friction on the rounds being fed into the firearm. They are also less prone to suffering from misalignment of the ammunition if a loaded magazine is dropped on the ground. However, conventional single stack magazines are still vulnerable to malfunction if the nose of a cartridge gets higher or lower than the chamber of the barrel when the cartridge is being fed into the firearm. Conventional single stack magazines can also experience rim lock. Rim lock is caused by the rims of improperly stacked cartridges impeding each other from feeding into the firearm. Rim lock occurs when the rim of the uppermost cartridge is positioned behind the rim of the shell immediately below. As a result, the uppermost shell cannot feed forward into the firearm, resulting in a jammed magazine.

Therefore, a need exists for a new and improved magazine with removable feed lip element that eliminates failure to feed events because of cartridge nose up and nose down malfunctions and rim lock. In this regard, the various embodiments of the present invention substantially fulfill at least some of these needs. In this respect, the magazine with removable feed lip element according to the present invention substantially departs from the conventional concepts and designs of the prior art, and in doing so provides an apparatus primarily developed for the purpose of preventing the cartridges from jamming from both nose up and nose down malfunctions and rim lock.

SUMMARY OF THE INVENTION

The present invention provides an improved magazine with removable feed lip element, and overcomes the above-mentioned disadvantages and drawbacks of the prior art. As such, the general purpose of the present invention, which will be described subsequently in greater detail, is to provide an improved magazine with removable feed lip element that has all the advantages of the prior art mentioned above.

To attain this, the preferred embodiment of the present invention essentially comprises a tubular body having a lower end and an upper end that defines an elongated passage that receives a spring and a detachable feed element positioned on top of the upper end of the passage that has feed lips that retain cartridges in the magazine and permit the cartridges to be extracted forwardly. The feed element may be a U-shaped device having a main upper panel that defines a feed lip aperture. The feed element may have side walls with fasteners that connect the feed element to the body. The feed element may have opposed sides, the aperture may be defined by the opposed sides, and a spring may be attached to one of the opposed sides to provide a biasing force toward the other opposed side such that a cartridge cannot be extracted from the aperture except in a forward direction. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
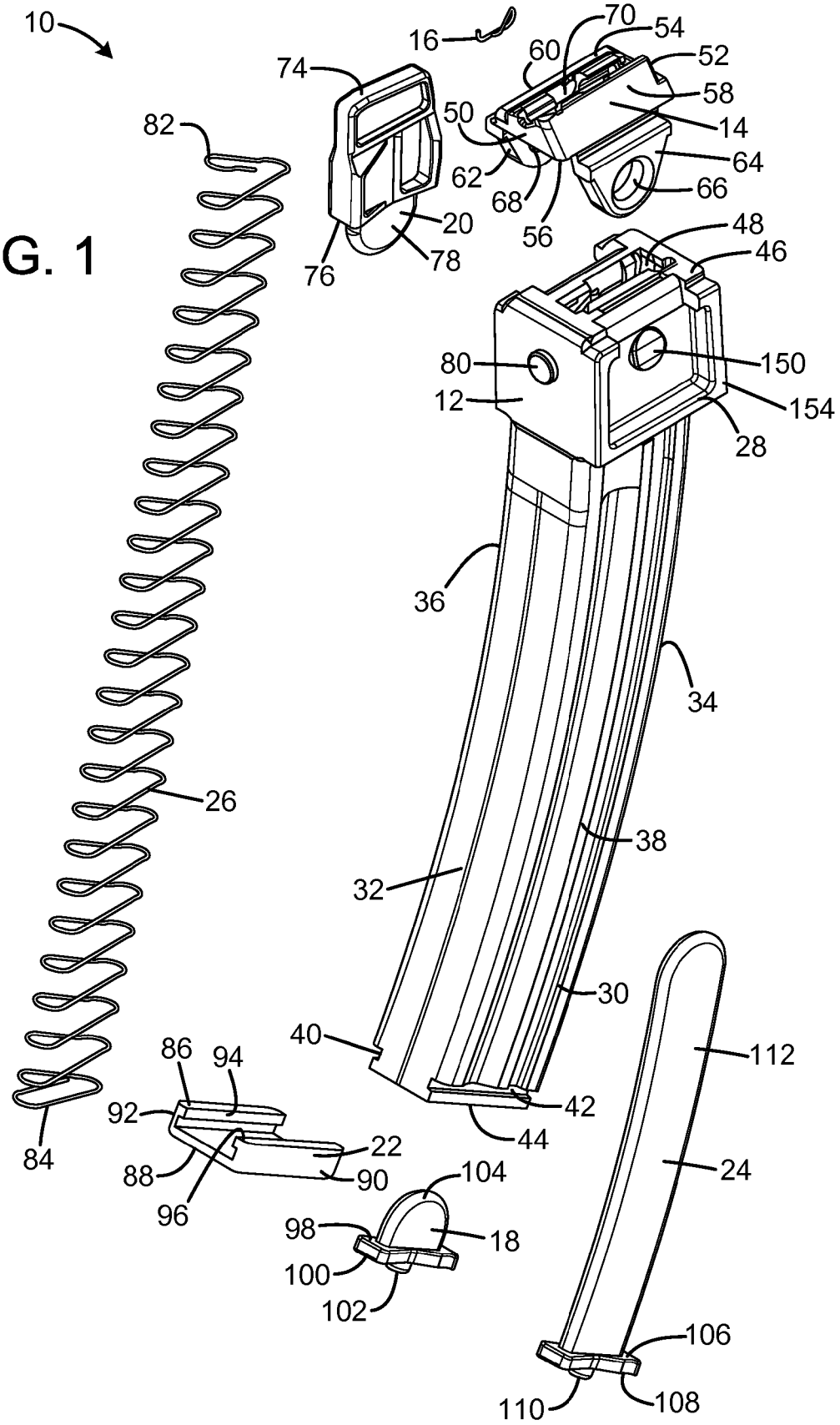
FIG. 1 is an exploded view of the current embodiment of the magazine with removable feed lip element constructed in accordance with the principles of the present invention.

An embodiment of the magazine with removable feed lip element of the present invention is shown and generally designated by the reference numeral 10.

FIGS. 1A-1C illustrate the improved magazine with removable feed lip element 10 of the present invention. More particularly, the magazine with removable feed lip element 10 has a body 12. The body is generally tubular, and has a front 32, rear 34, right side 36, left side 38, upper portion 28 with a top 46, and a lower portion 30 with a bottom 44. The top of the upper portion defines an aperture 48. The front and rear of the upper portion each have a molded in insert/post 80 (the rear post is not visible) to increase reliability. The posts interlock with a firearm to releasably secure the magazine 10 to the firearm. In the current embodiment, the posts are made of steel or any other suitable metal. These inserts can be two separate pieces molded in or a single round or U-shaped investment cast piece that is overmolded for increased strength.

The bottom rear of the upper portion forms a raised ramp area 154. The raised ramp area allows better lock up between the feed lip element and the body. This promotes consistent feed lip alignment and reliability of feed, even when the user is prone and rests the weight of the firearm on the magazine. The left and right sides of the upper portion form feed lip latches 150 (only one of which is visible). The lower portion is gently curved towards the front so the magazine can be used with rimmed ammunition. In the current embodiment, the entire body is injection molded as a single piece, providing rigidity and structural stability. The hollow interior of the body, which is an elongated central passage that communicates with the aperture 48, is created by a removable mold insert. However, the body can also be constructed in multiple pieces that are attached by clips, locking tabs, screws, rivets, or other fastening means.

The bottom 44 of the lower portion 30 is open to receive a follower 20, a rectangular coil spring 26, and a lock plate 18 or 24 within the hollow interior of the body 12. The lock plate 18 is used when the magazine 10 holds 25 rounds, and the lock plate 24 is used when the magazine 10 holds 10 rounds. Only one of the lock plates is used at a time. The left and right sides 36, 38 of the bottom of the lower portion define slots 40 and 44. A base plate 22 forms flanges 94, 96 on the top 86 of its left and right sides 90, 92 that are received in the slots 40, 42 of the lower portion. The base plate closes the bottom end of the body and secures the follower, spring, and lock plate within the body.

The follower 20 has a top 74 and a bottom 76. The top 74 urges the bottommost cartridge upwards, and the bottom forms a spring engagement element 78 that protrudes downwards. The spring engagement element is inserted into the top 82 of the spring 26.

The twenty-five round lock plate 18 has a top 98 that forms a spring support 104. The spring support 104 is inserted into the bottom 84 of the spring 26. The bottom 100 of the lock plate 18 forms a downwardly protruding lock plate button 102. Pressure exerted by the spring urges the lock plate button 102 into an aperture in the base plate 22 (not visible) to prevent lateral movement of the base plate while the flanges 94, 96 engaged with the slots 40, 42 on the bottom of the body prevent axial movement.

The ten round lock plate 24 has a top 106 that forms a spring support 112. The spring support 112 is inserted into the bottom 84 of the spring 26. The spring support 112 is substantially taller than the spring support 104 of the lock plate 18 to prevent the insertion of more than ten cartridges into the magazine 10 when the lock plate 24 is installed. The bottom 108 of the lock plate 24 forms a downwardly protruding lock plate button 110. Pressure exerted by the spring urges the lock plate button 110 into an aperture in the base plate 22 (not visible) to prevent lateral movement of the base plate while the flanges 94, 96 engaged with the slots 40, 42 on the bottom of the body prevent axial movement.

A feed lip element 14 is an inverted U-shape or saddle-shaped element that fits over the top 46 and left and right sides 38, 36 of the upper portion 28. The feed lip element defines a central aperture 70 that is axially registered with the aperture 48 in the top 46 of the upper portion. The bottom 56 of the feed lip element defines two downwardly protruding ears 62, 64 on the left and right sides 58, 60. The ears 62, 64 each define an aperture 68, 66. The apertures receive the feed lip latches 150 on the left and right sides 38, 36 of the upper portion to releasably secure the feed lip element to the upper portion. The uppermost portions of the feed lip latches are tapered to facilitate insertion into the apertures of the ears. A feed control spring 16 is attached to the top 54 of the feed lip element within the aperture 70. The feed control spring will be described in more detail subsequently. In the current embodiment, the feed lip element is injection molded as a single part. Because it is easily removed from the body 12, the feed lip element can be inexpensively replaced in the event of excessive wear without requiring replacement of the entire magazine 10. The feed lip element can be constructed of polymer, metal, or polymer overmolded onto metal.

Figure 2A:
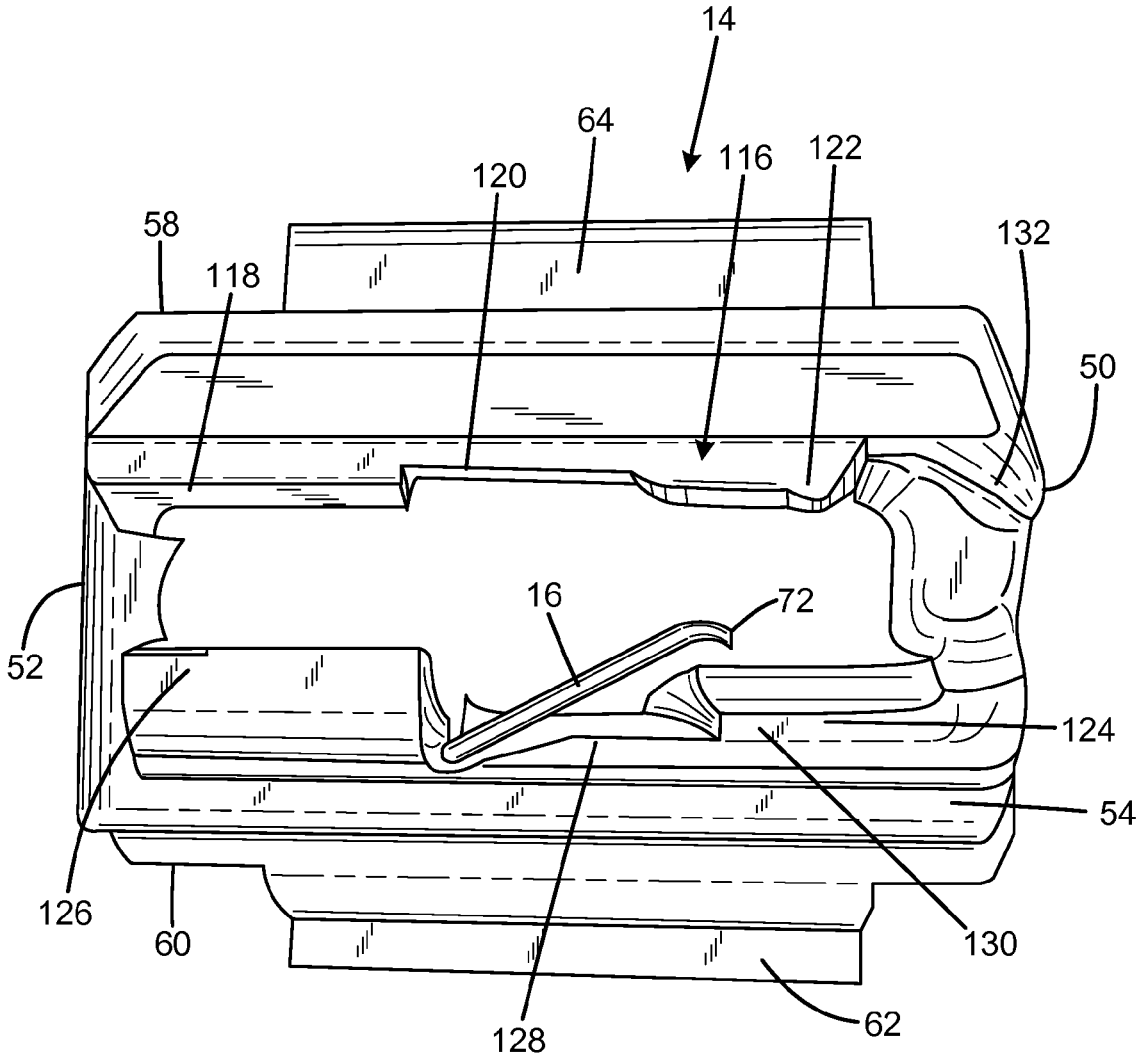
FIG. 2A is a top isometric view of the current embodiment of the removable feed lip element removed from the magazine with removable feed lip element of FIG. 1.
Figure 2B:
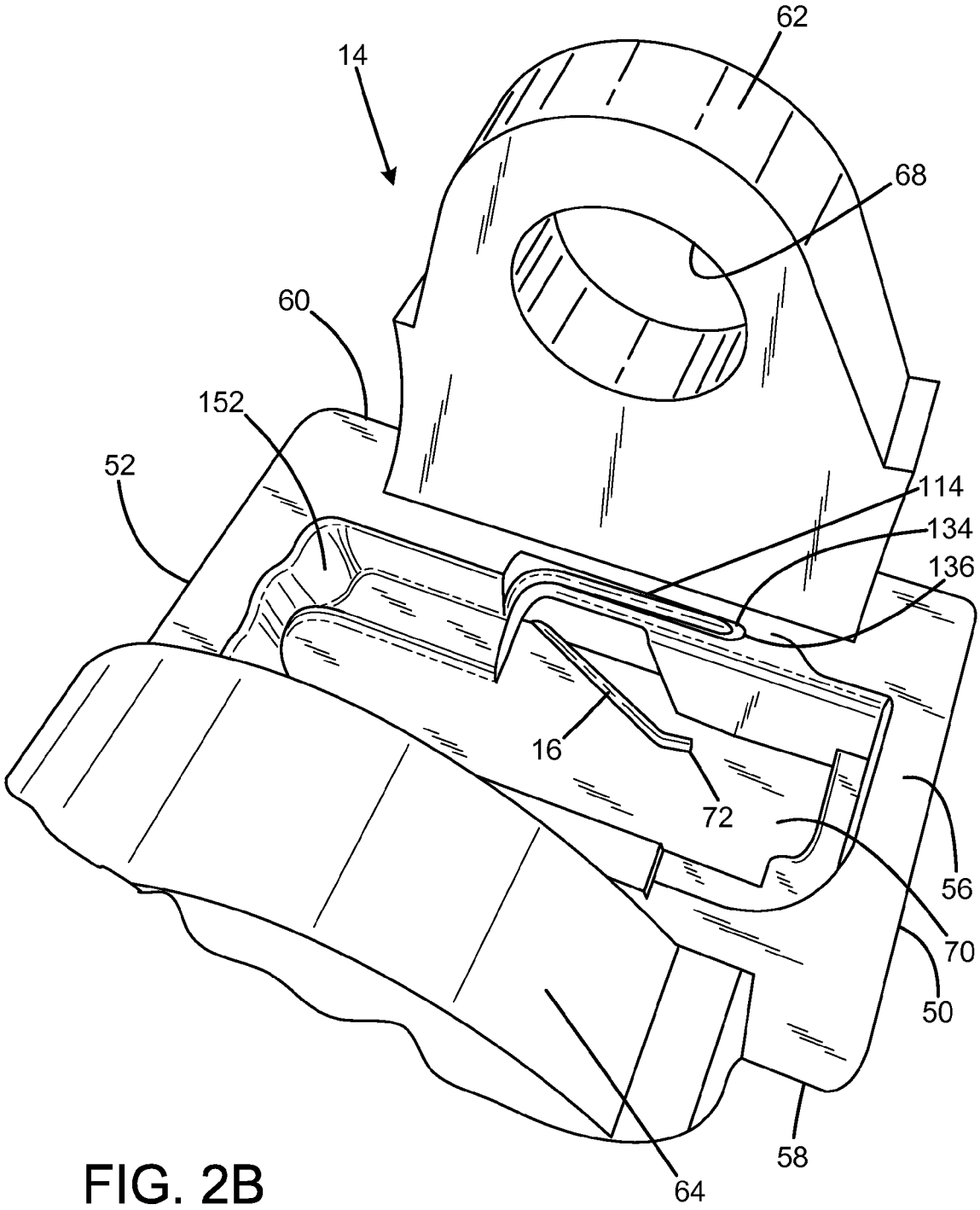
FIG. 2B is a bottom perspective view of the current embodiment of the removable feed lip element removed from the magazine with removable feed lip element of FIG. 1.

FIGS. 2A and 2B illustrate the feed lip element 14 of the present invention. More particularly, the feed lip element is shown detached from the upper portion 28 of the body 12 so the features of the aperture 70 and feed control spring 16 can be clearly discerned. Referring now to FIG. 2A, the top 54 of the aperture 70 is defined by a left feed lip 116 and a right feed lip 124. The left feed lip has a rear portion 118, a middle portion 120, a front portion 122, and a protrusion 132. The right feed lip has a rear portion 126, a middle portion 128, and a front portion 130. The feed control spring 16 is engaged with the feed lip element such that the tip 72 of the feed control spring protrudes inwards toward the left feed lip in the recessed middle portion 128 of the right feed lip. The function of the feed lips will be described in more detail in the description of FIGS. 3A-C. Feed lip elements with different feed lip configurations can be used to adapt to the type of ammunition in the magazine (i.e. round nose, flat point, or hollow point).

Referring now to FIG. 2B, the opposite tip 136 of the feed control spring 16 is shown received by a hole 134 in the bottom 56 right side 60 of the feed lip element 14. The adjacent portion of the feed control spring is received in a slot 114 to releasably secure the feed control spring to the feed lip element. The rear 52 of the aperture 70 has a forward sloped portion 152. The sloped portion prevents rim lock by causing the uppermost cartridge to jump over the cartridge immediately beneath it as the uppermost cartridge rises, but before extraction of the uppermost cartridge begins.

Figure 3A:
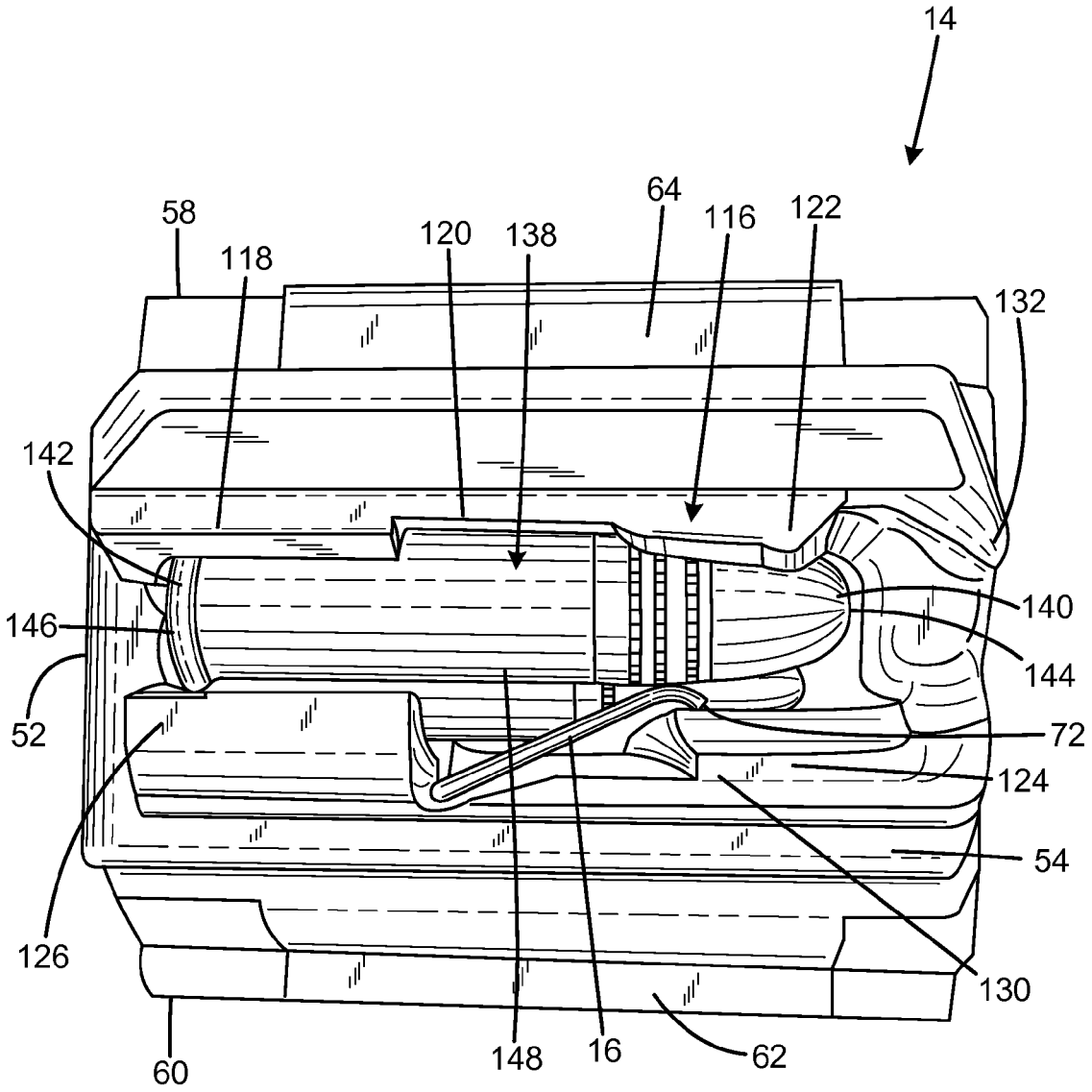
FIG. 3A is a top isometric view of the current embodiment of the magazine with removable feed lip element in a loaded condition prior to a cartridge being stripped from the magazine.
Figure 3B:
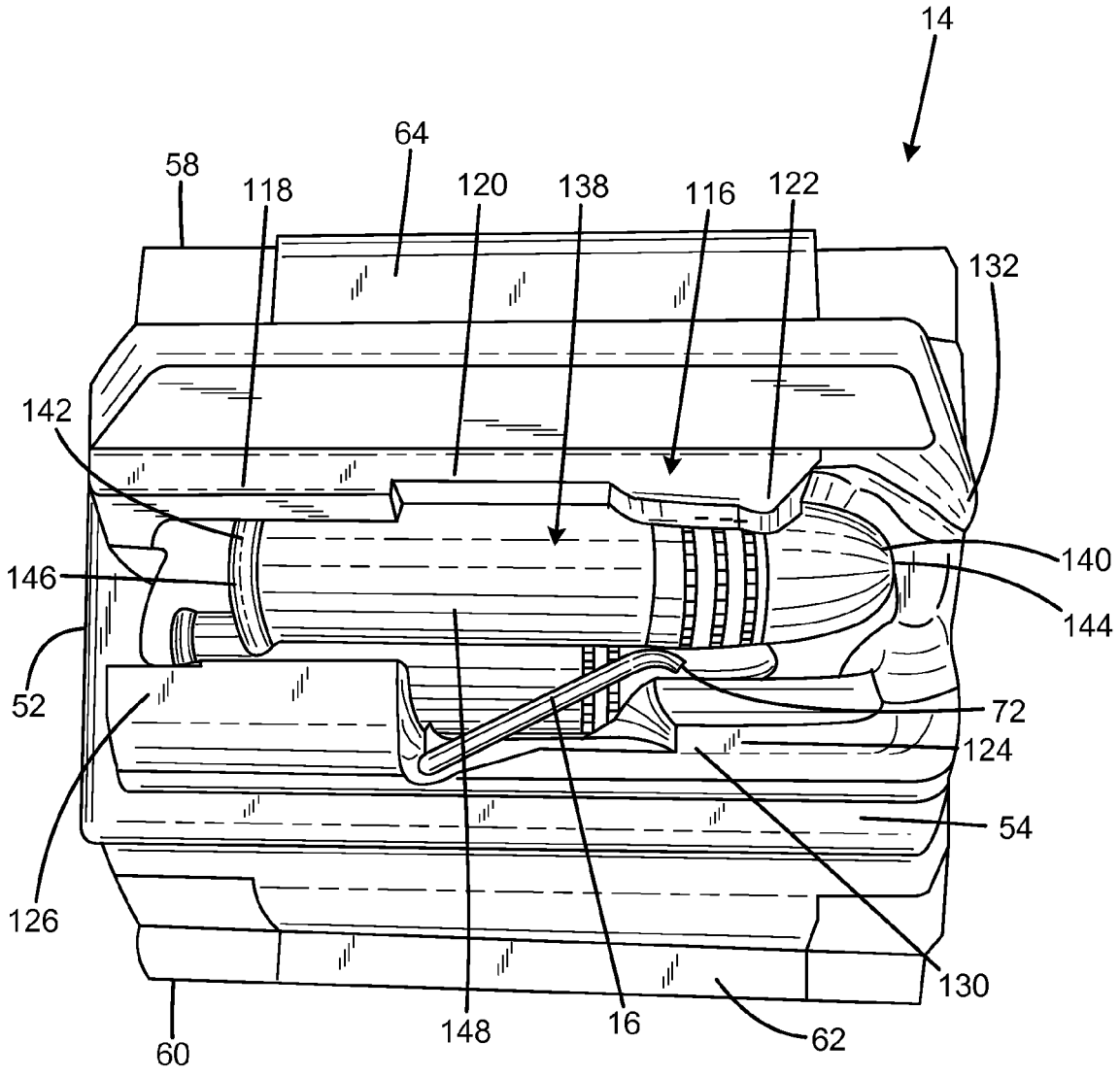
FIG. 3B is a top view of the current embodiment of the magazine with removable feed lip element in a loaded condition with a cartridge partially stripped from the magazine.
Figure 3C:
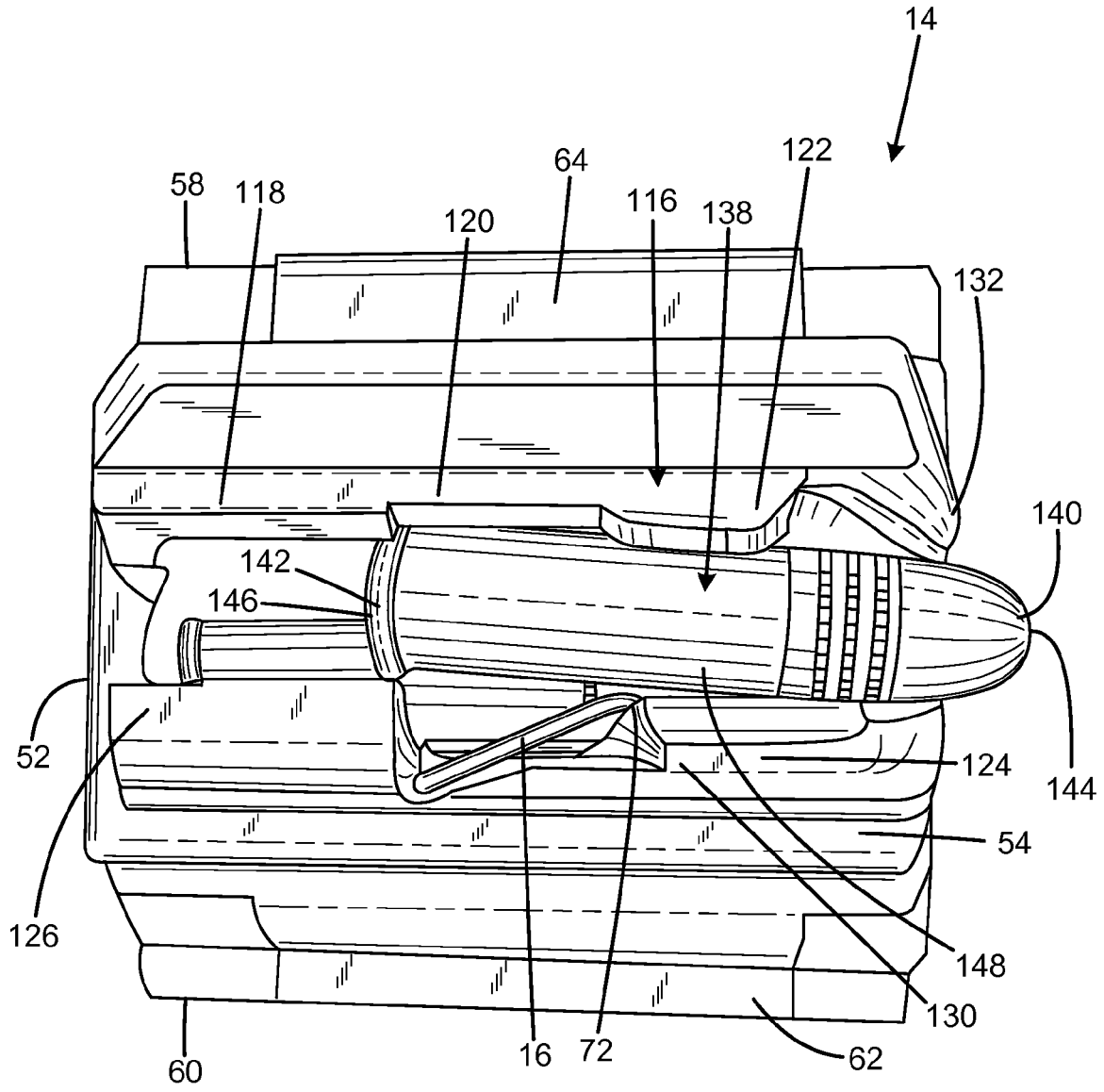
FIG. 3C is a bottom isometric view of the current embodiment of the magazine with removable feed lip element in a loaded condition with a cartridge being stripped from the magazine.

FIGS. 3A-3C illustrate the magazine 10 of the present invention. More particularly, the series of illustrations depict the stripping of a cartridge 138. In the current embodiment, the cartridges 138 are .22 rimmed cartridges. The rear 146 of each cartridge forms a rim 142. The nose 144 of a bullet 140 protrudes from each of the cartridges. Each cartridge is positioned forward of the cartridge below to prevent rim lock.

Referring now to FIG. 3A, the rear portions of the left and right feed lips 116, 124 are spaced to create a narrow gap portion of the aperture 70 that prevents the rim 142 of a cartridge 138 from rising through that gap. The middle portions are recessed to create a wider gap portion of the aperture 70 that permits the rim of a cartridge to pass through to pop up and out as the cartridge is stripped forwardly from the feed lip element. The wider gap also enables cartridges to be loaded through that gap. The tip 72 of the feed control spring 16 is angled to parallel the exterior 148 of the cartridge 138. The feed control spring is biased to exert lateral pressure on the cartridge against the left feed lip. This enables the front portion 122 of the left feed lip to engage the bullet and prevent the nose of the bullet popping up or down excessively, thereby preventing both nose up and nose down malfunctions.

Referring now to FIG. 3B, the stripping of the uppermost cartridge 138 from the magazine 10 has begun. The cartridge moves forward and the nose 144 of the bullet 140 initiates contact with the protrusion 132. The rear portions 118, 126 of the feed lips 116, 124 continue to retain the rim 142 of the cartridge, but the cartridge begins to be repositioned upward and to the right against the spring force exerted by the feed control spring 16. This relocates the nose of the bullet in a better position for feeding. The feed control spring provides a small amount of friction and is flexed slightly to enable the cartridge detailed, but neither of these forces is large enough to interfere with the normal operation of the firearm's cartridge stripping mechanism.

Referring now to FIG. 3C, the stripping of the uppermost cartridge 138 from the magazine 10 is almost complete. The nose 144 of the bullet 140 has been shifted upward and to the right as the cartridge 138 has slid forward. The rim 142 is about to clear the rear portions 118, 126 of the feed lips 116, 124 so the cartridge can be lifted free of the magazine 10. The feed control spring 16 continues to provide a biasing force toward the left feed lip 116 such that the cartridge cannot be extracted from the aperture 70 except in a forward direction.

In the context of the specification, the terms "rear" and "rearward," and "front" and "forward" have the following definitions: "rear" or "rearward" means in the direction away from the muzzle of the firearm while "front" or "forward" means it is in the direction towards the muzzle of the firearm.

While a current embodiment of a magazine with removable feed lip element has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A magazine for a firearm comprising:

a tubular body having a lower end and an upper end that defines an elongated passage that receives a spring;

a detachable feed element positioned on top of the upper end of the passage;

wherein the feed element has feed lips that retain cartridges in the magazine and permit the cartridges to be extracted forwardly;

the feed element having opposed sides;

an aperture defined by the opposed sides of the feed element;

a feed control spring having one end attached to one of the opposed sides to provide a biasing force toward the other opposed side such that a cartridge cannot be extracted from the aperture except in a forward direction;

the feed element having side walls with two protruding ear fasteners;

each ear defining an aperture;

the upper end of the body having two feed lip latches that protrude outwardly from the body; and wherein the feed lip latches are inserted into the apertures in the ear fasteners to releasably retain the feed element on top of the upper end of the passage of the body.

2. The magazine of claim 1 wherein the feed element is a U-shaped device having a main upper panel that defines a feed lip aperture.

3. The magazine of claim 1 further comprising a base plate element removably connected to the lower end of the body by flanges on the base plate element that are received in slots defined by the lower end of the body.

4. The magazine of claim 1 further comprising a follower movable within the elongated passage.

5. The magazine of claim 1 wherein the spring within the passage has a first end contacting a base plate, and has an opposed second end contacting and biasing a follower toward the upper end of the body.

6. The magazine of claim 1 wherein the feed control spring has a free end that flexes and is angled to parallel the cartridge exterior.

7. The magazine of claim 1 wherein only one of the opposed sides of the feed element has a forward protrusion such that the forward protrusion urges a cartridge toward the other opposed side as the cartridge moves forward in contact with the forward protrusion.

8. The magazine of claim 1 wherein the feed element has a rear surface that has a forward slope such that an uppermost cartridge rises over a cartridge immediately beneath as the cartridges rise to ensure the uppermost cartridge is in front of the cartridge immediately beneath before the uppermost cartridge is extracted from the aperture.

9. The magazine of claim 1 wherein the tubular body is a single unitary body.

10. The magazine of claim 1 wherein the feed lip latches have uppermost portions that are tapered to facilitate insertion of the feed lip latches into the apertures of the ears by pushing the ears downwards over the feed lip latches.

11. A magazine for a firearm comprising:

a tubular body having a lower end and an upper end that defines an elongated passage that receives a spring;

the upper end of the body having a pair of opposed engagement surfaces facing in opposed lateral directions;

each engagement surface having an engagement element portion deviating from the engagement surface;

a detachable feed element positioned on top of the upper end of the passage;

the feed element having an upper portion defining an extraction aperture defined in part by a pair of feed lips;

the feed element having opposed downwardly depending ear portions;

each ear portion having a medial surface facing the opposed ear; and each ear portion having an engagement feature adapted to operably engage the engagement element portion of the body to secure the feed element to the body.

12. The magazine of claim 11 wherein at least one of the engagement element portions is a protrusion.

13. The magazine of claim 12 wherein the ears each include a selected portion immediately below the engagement feature, and wherein the selected portions are spaced apart by less than the distance between lateral-most portions of the protrusions, such that the ears must flex to snap the feed element onto the body.

14. The magazine of claim 11 wherein at least one of the engagement features of the ear portion is an aperture.

15. The magazine of claim 14 wherein the engagement feature closely receives the engagement element.

16. The magazine of claim 11 wherein the ears are resilient, such that they operate to flex to attach and remove the feed element with respect to the body.

* * * * *